US012637914B2

(12) United States Patent
Hughes

(10) Patent No.: US 12,637,914 B2
(45) Date of Patent: May 26, 2026

(54) REVERSE CIRCULATION JET PUMP AND REAMING STABILIZER

(71) Applicant: William James Hughes, Highlands Ranch, CO (US)

(72) Inventor: William James Hughes, Highlands Ranch, CO (US)

( * ) Notice: Subject to any disclaimer, the term of this patent is extended or adjusted under 35 U.S.C. 154(b) by 0 days.

(21) Appl. No.: 19/369,200

(22) Filed: Oct. 25, 2025

(65) Prior Publication Data

US 2026/0117611 A1 Apr. 30, 2026

Related U.S. Application Data

(60) Provisional application No. 63/712,929, filed on Oct. 28, 2024.

(51) Int. Cl.
*E21B 21/08* (2006.01)
*E21B 7/04* (2006.01)
*E21B 41/00* (2006.01)

(52) U.S. Cl.
CPC ..... *E21B 21/085* (2020.05); *E21B 7/046* (2013.01); *E21B 41/0078* (2013.01)

(58) Field of Classification Search
CPC ..... E21B 21/085; E21B 7/046; E21B 41/0078
See application file for complete search history.

(56) References Cited

U.S. PATENT DOCUMENTS

| | | | | |
|---|---|---|---|---|
| 2,946,565 | A | 7/1960 | Williams | |
| 3,454,119 | A * | 7/1969 | Mcclinton | E21B 10/60 175/424 |
| 4,630,691 | A | 12/1986 | Hooper | |
| 5,355,967 | A | 10/1994 | Mueller et al. | |
| 5,775,443 | A | 7/1998 | Lott | |
| 11,168,526 | B1 * | 11/2021 | Hughes | E21B 7/04 |
| 11,377,919 | B2 | 7/2022 | Hughes | |
| 11,732,929 | B2 | 8/2023 | Hughes | |

FOREIGN PATENT DOCUMENTS

GB 2432380 A * 5/2007 ..... E21B 21/103

* cited by examiner

*Primary Examiner* — Caroline N Butcher
(74) *Attorney, Agent, or Firm* — Michael Reilly LLC

(57) ABSTRACT

A jet pump reamer/stabilizer drilling assembly is used during the underbalanced or near-balanced drilling of an oil, gas, geothermal, or sequestration well or disposal reservoir to create a low pressure zone around the drill bit. The design of this jet pump drilling reamer/stabilizer assembly limits the flow of drilling/power fluid through the drill bit. The drilling fluid circulation behind the drill bit is a conventional flow down the drill pipe and back up through the annulus. The drilling fluid circulation around and up through the drill bit is reverse circulation.

7 Claims, 4 Drawing Sheets

REVERSE CIRCULATION JET PUMP AND REAMING STABILIZER

CROSS REFERENCE TO RELATED APPLICATIONS

This application claims the benefit of U.S. Provisional Patent Application No. 63/712,929, entitled "Reverse Circulation Jet Pump" to William James Hughes, filed on Oct. 28, 2024, which is hereby incorporated by reference in its entirety.

FIELD

Various embodiments described herein relate to drilling deep wells in hot dry rock and other rock formations, and devices, systems and methods associated therewith.

BACKGROUND

The most common method of drilling deep wells in use today is rotary drilling, whether for oil and gas, white hydrogen, geothermal energy production, or carbon dioxide sequestration. In rotary drilling, the drill bit is constantly rotating in contact with the rock formation, which wears out the drill bit and also generates heat which exacerbates the wear. The drill bit must be lubricated to extend its useful life, and the lubricating fluid cools the bit, which further extends its life. Drilling with water alone proved ineffective, and therefore drilling fluids or "muds" of various compositions were developed. In most conventional oil and gas drilling projects, the drilling fluid is pumped down the drill pipe, down through the drill bit, and returns to the surface via the annulus between the drill pipe and the well bore. The drilling fluid also removes the cuttings and brings them to the surface, where they are filtered out before the drilling fluid is recirculated back into the well.

A less commonly used method is to pump the drilling fluid down the annulus between the drill pipe and the well bore, around and up through the drill bit and back to the surface through the drill pipe. This is referred to as "reverse circulation" drilling.

The weight of the drilling fluid in the well exerts a pressure against the rock formation around the drill bit which often far exceeds the pressure of the fluids contained within the formation. This condition is referred to as "overbalanced". Drilling engineers in the oil and gas industry rapidly adopted the overbalanced approach, because it helps prevent blowouts caused by high pressure fluids in the formation, such as had happened at Spindletop. Heavier drilling muds were developed with the specific purpose of preventing any formation fluids entering the wellbore during drilling.

However, the result was extensive and largely irreversible damage to the rock formations as the high pressure drilling fluid entered the pores of the rock and plugged them very effectively. Once drilling ceased and production began, the flow of the desired hydrocarbons was significantly reduced due to this formation damage.

In response to the problems described above, some companies adopted underbalanced drilling. In conventional underbalanced drilling, the well is drilled using a drilling fluid with a lower density, thereby reducing the hydrostatic pressure exerted at the drill bit by the column of drilling fluid. When this hydrostatic pressure is lower than the pressure of the fluids in the formation, the operation is considered to be "underbalanced". Formation damage caused by plugging of the rock pores is avoided, and the porosity and permeability of the formation are not impacted.

When drilling for oil or gas, underbalanced drilling does not offer the protection from blowouts afforded by the heavy drilling mud of overbalanced drilling. Therefore additional precautions must be taken and additional equipment installed to handle any possible excess pressure situation.

Near Balanced Reservoir Drilling, as the name implies, is a variation on underbalanced drilling in which the pressure exerted by the drilling fluid is maintained close to, but not above, the pressure of the fluids in the formation being drilled. For a discussion of the issues relating to Near Balanced Reservoir Drilling, including operator safety and production while drilling, see U.S. Patent No. U.S. Pat. No. 11,377,919 entitled "Annular Pressure Cap Drilling Method" to William James Hughes, issued on Jul. 5, 2022 which is hereby incorporated by reference in its entirety.

In current drilling methods, even those methods which claim to be underbalanced are not underbalanced ahead of the drill bit. Within the dynamic drilling environment around the drill bit, the drilling fluids which pass through the drill bit to lubricate the drill bit and remove the cuttings are under a higher pressure than the formation pressure of the rocks being drilled. This overbalanced condition in front of the bit causes damage to the formation, because the drilling fluids enter the naturally occurring microfractures and destroy the near wellbore permeability of the formation. Even though the overbalanced condition in front of the bit exists for a short period of time, it is sufficient to cause irreversible damage to the pores and microfractures around the drill bit location.

Some operators have developed techniques to reduce the pressure but not necessarily be underbalanced around the drill bit. Their objective has been to reduce chip hold down, not to address the problem of formation damage. In every case, these techniques create a localized lower pressure zone around the drill bit, but then revert to full overbalanced conditions immediately behind the drill bit. Formation damage is therefore still occurring during drilling operations.

Many of the issues described above apply to drilling other than for exploration for, or production of, oil or gas. For example, the purpose of the well may be to generate geothermal energy, or sequester carbon dioxide emissions, or as a disposal well for harmful materials including chemical and nuclear waste. Sometimes a well may be drilled for a combination of these purposes, as exemplified in U.S. Pat. No. 11,732,929 entitled "Optimized CO2 Sequestration and Enhanced Geothermal System" to Hughes, issued on Aug. 22, 2023 which is hereby incorporated by reference in its entirety.

When drilling in a formation such as granite, or deep hot dry rock, where there are no hydrocarbon reserves, high pressure blowouts do not pose the same level of risk as they do when drilling for oil and gas. Whether the purpose of the well is to produce hydrocarbons, sequester CO2, generate geothermal energy, or dispose of unwanted substances, the one key consideration while drilling the working zone of the well is to avoid formation damage. Geothermal projects often employ oilfield drillers who use oilfield techniques, including heavy drilling muds and hydraulic fracturing. Once the natural fracture system and the pores in the rock formation are plugged with heavy drilling mud, then it becomes much harder for CO2 or a geothermal heat transfer fluid or waste fluids to flow into the formation.

Formation damage is one of the reasons why geothermal projects have not lived up to expectations. Underbalanced drilling or non damaging reservoir drilling therefore should be the technique of choice for drilling any deep well, not just oil and gas wells. The use of a lighter drilling fluid offers the additional benefit of faster drilling rates and less wear on the drill bit, meaning less time tripping and changing drill bits. Additionally, there is a need for drilling technology designed specifically for drilling in the hot dry rock and similar formations which are often chosen as suitable for geothermal energy production.

SUMMARY

There is provided a system for drilling an oil, gas, geothermal, or sequestration well or waste disposal reservoir comprising; a drill pipe; a drilling fluid pumped down the drill pipe; a bottom hole assembly attached to the drill pipe, the bottom hole assembly further comprising; a jet pump housing containing a jet pump, the jet pump having a venturi system through which the drilling fluid pumped down the drill pipe is directed into an annulus between the wellbore and the drill pipe; conduits in the jet pump housing through which some drilling fluid flows from within the jet pump housing via orifices into the wellbore around the drill bit, through the drill bit and venturi system and back to the surface; a reamer/stabilizer surrounding the jet pump housing and a rotary drill bit attached to the bottom hole assembly.

Further embodiments are disclosed herein or will become apparent to those skilled in the art after having read and understood the specification and drawings hereof.

BRIEF DESCRIPTION OF THE DRAWINGS

Different aspects of the various embodiments of the invention will become apparent from the following specification, drawings and claims in which:

The drawings are not necessarily to scale. Like numbers refer to like parts or steps throughout the drawings.

DETAILED DESCRIPTION OF SOME EMBODIMENTS

Figure 1:
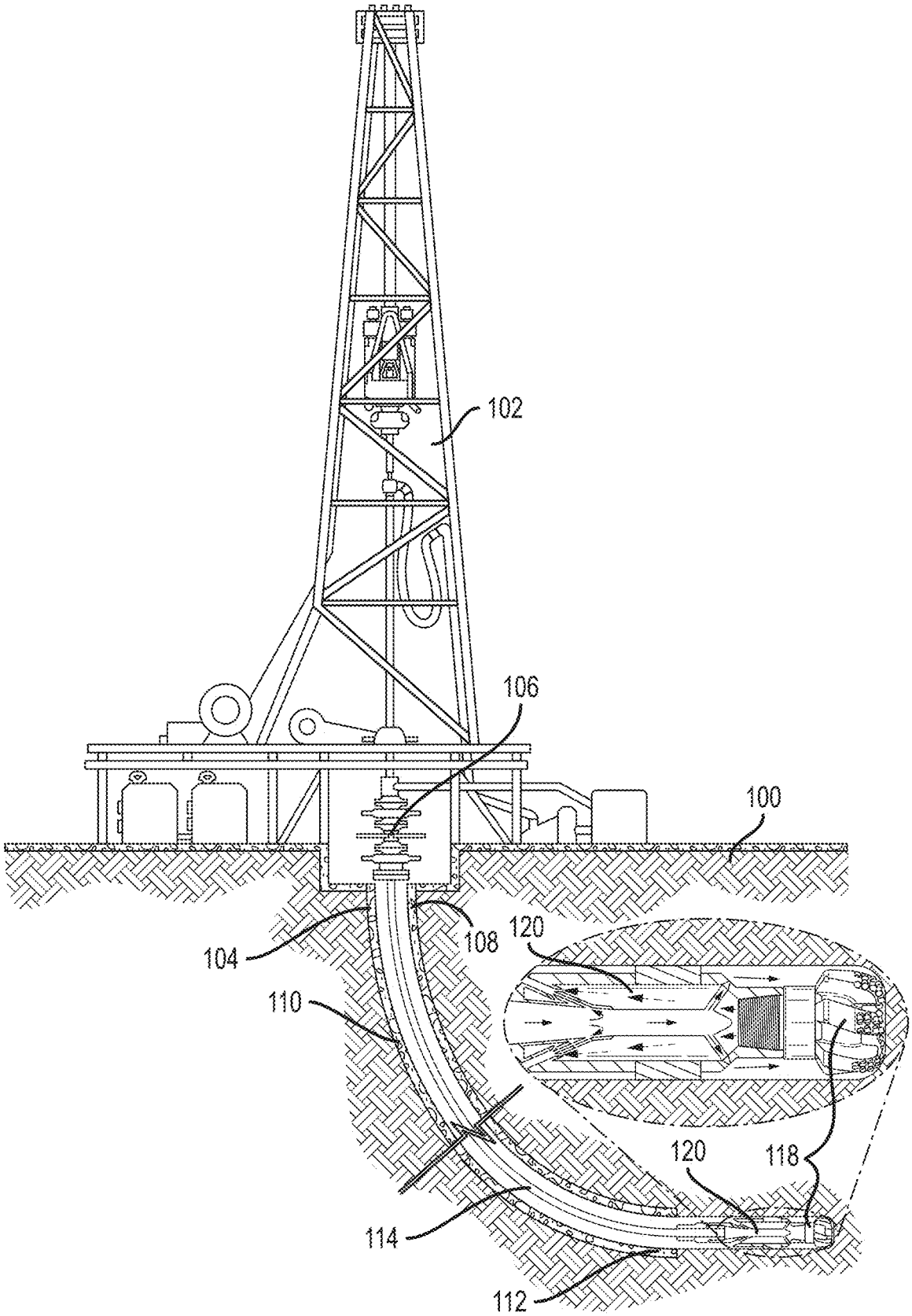
FIG. 1 shows a well being drilled using a reverse circulation jet pump reamer/stabilizer.

In the following description, specific details are provided to impart a thorough understanding of the various embodiments of the invention. Upon having read and understood the specification, claims and drawings hereof, however, those skilled in the art will understand that some embodiments of the invention may be practiced without hewing to some of the specific details set forth herein. Moreover, to avoid obscuring the invention, some well-known methods, processes and devices and systems finding application in the various embodiments described herein are not disclosed in detail.

Unlike conventional underbalanced drilling the NDRD technique addresses the issue of multiple potential formation damage mechanisms. It starts with replacing heavy drilling mud as the primary means of controlling pressure in the well, instead using other surface BOP devices placed below the traditional BOP stack. These devices allow the safe use of a light drilling fluid, such that the weight of the column of drilling fluid exerts less pressure against the rock formation. However, the one place in which the formation pressure is usually exceeded while drilling is the small area of the well bore ahead of and surrounding the drill bit. The drilling fluid can enter the side walls of the well bore under pressure, and cause enough formation damage to the pores and microfractures within the formation to adversely impact permeability, and inhibit the production of hydrocarbons during and after drilling.

Another issue facing the driller which is addressed by the present invention is the "chip hold-down effect", which happens when the chips of rock loosened by the drill bit are held in place by the pressure of the drilling fluid and are not immediately moved uphole. The rotating drill bit is then just re-drilling the chips to a finer and finer powder. This slows down the drilling rate of penetration (ROP) and increases wear on the bit. Increased wear may mean that the drill bit has to be changed, possibly several times. This increases costs, not only for replacing the drill bits, but also for the time taken to extract the bit, change it, and reposition it in place to resume drilling.

The key to increasing ROP and reducing drill bit wear is to move the rock chips away from the bit as quickly as possible and let the drill bit grind on the formation. Some techniques to do this use a modified jet pump to decrease the bottomhole pressure, with the intent to remove cuttings more effectively.

Many of these techniques add a complication by trying to create a lower pressure at the drill bit while maintaining the required overbalanced condition, that is, higher pressures, for the column of drilling fluid from the drill bit back to the surface. By contrast, the present invention aims to keep a negative or low underbalanced condition all the way to the surface, by providing added energy to the returning power and formation fluids thus assisting in removing the rock chips.

Prior drilling techniques pump fluid through the drill bit, which still exerts pressure on the rock face as it is being drilled. Conventional thinking is that fluid must be pumped through the drill bit to lubricate the drill bit and reduce wear on the cutting faces. While that is basically correct, the volume and weight of fluid needed for lubrication and chip removal has not been addressed as a stand-alone question. Instead, the volume and weight of the drilling fluid has been dictated by the values needed to prevent blowouts, with the presumption that this is more than sufficient to lubricate the bit and remove the chips when all the fluid is free to flow through the drill bit. In reality, it is far more fluid than is necessary. The present invention directly addresses the question of how much, or more precisely, how little, drilling fluid is really necessary to lubricate the drill bit and remove the cuttings.

One solution which reduces formation damage in hydrocarbon producing wells is disclosed in U.S. Utility Pat. No. 11,168,526, hereinafter "the '526 patent", entitled "Jet Pump Drilling Assembly" to William James Hughes, issued on Nov. 9, 2021, which is hereby incorporated by reference in its entirety. This patent discloses a jet pump and drill bit combination wherein no drilling fluid flows through the drill bit in either direction. This patent is based on the premise that this approach is used while drilling, usually horizontally, in a hydrocarbon producing formation. Lubrication for the drill bit is provided only by the fluids produced from the formation being drilled flowing up through the drill bit. If the volume of produced hydrocarbons is commercially realistic, then it will be sufficient to lubricate the drill bit and to remove the cuttings. If that condition is not met, the low level of production of hydrocarbons from the well would result in the well being abandoned.

This technique is clearly applicable only when drilling in a hydrocarbon producing formation. The '526 patent is obviously not a solution for drilling in non-hydrocarbon bearing formations. It would not be applicable when drilling a deep geothermal well in hot rock formations, or in deep granite. These formations do not produce hydrocarbons to serve as lubricants for the drill bit, so it is necessary to supply lubrication to the drill bit. However, pumping all the drilling fluid through the drill bit brings back the problems mentioned above, including formation damage. This is especially true when a jet pump is used, as the drilling fluid must be pumped rapidly in order to create the suction effect within the jet pump. What is required is a way of limiting the flow of drilling fluid through the drill bit to just enough to lubricate the drill bit and remove the cuttings, but no more than the absolute minimum flow necessary.

The present invention addresses these concerns and offers several advantages over conventional underbalanced drilling. It does so by taking a very different approach to drilling, ensuring near balanced or underbalanced conditions during the entire time the vertical or horizontal well is being drilled including in front of the bit.

The major difference between the present invention and conventional drilling, whether overbalanced or underbalanced, is that only a small and controlled volume of a lightweight drilling fluid exits out of the drill pipe through the jet pump and into the annulus between the drill pipe/bit and the formation being drilled. Previous jet pump assist technologies allow large volumes of the drilling fluids. All the drilling fluid being pumped down the well—to flow down through and out of the drill bit, so the controlled and limited flow of drilling fluids through the drill bit distinguishes the present application from these earlier systems.

In this approach the well is drilled underbalanced or slightly underbalanced above the drill bit and a low pressure zone is created in front of the drill bit. The drilling fluid is pumped down through the drill pipe and into the jet pump. Most of the drilling fluid makes a U-turn to power the jet pump and returns back up the annulus between the drill pipe and the wellbore. A small controlled volume of drilling fluid flows out of conduits in the jet pump into the space between the wellbore and drill bit, up through the drill bit and back to the surface up the annulus between the drill pipe and the wellbore. The direction of drilling fluid flow is up through the drill bit, which is the opposite of conventional drilling, and is effectively reverse circulation drilling around the drill bit. Thus the drilling process is normal circulation above the drill bit, but reverse circulation around the drill bit. This hybrid approach is another aspect of the present invention which distinguishes it from the prior art.

Another aspect of the present invention which distinguishes it from the prior art is that other jet pump assist technologies are not designed to be underbalanced behind the bit, they only reduce pressure in front of the bit. The previous jet pump technologies used when drilling for oil and gas maintain full overbalanced conditions behind the bit and reduced overbalanced conditions in front of the bit for well control, so that the well does not produce hydrocarbons while drilling. In contrast, the present invention is designed to avoid formation damage by using underbalanced drilling both behind and in front of the drill bit.

The fluid pumped down the drill pipe is now referred to as power fluid. Its purpose is to power the jet pump. As stated above, the drill bit is designed such that only a small and controlled volume of fluid is pumped through the drill bit. Power, and where applicable, formation fluids are discharged into the return annulus above the jet pump which is located behind the drill bit. They are partially restricted from flowing back around the jet pump stabilizer to the drill bit because they are limited by a reamer/stabilizer. Maintaining this low pressure zone ensures that the formation is not damaged by high pressure fluids. Since no formation damage is created, there is no need for stimulation such as hydraulic fracturing. The result is substantial costs and time savings over previous techniques.

Although the power fluid is pumped down the drill pipe under pressure, the pressure is reduced as it exits the jet pump stabilizer. Thus, underbalanced conditions are achieved from the drill bit to the surface by adding energy to the return flow, essentially pumping the well for the duration of the drilling process.

The methods and systems described herein offer other benefits over conventional drilling. Previous techniques which attempted to create a lower pressure zone ahead of the drill bit were designed to address another consequence of hydraulic forces ahead of the drill bit, that is, chip hold-down. The cuttings are held in place against the rock face by the high pressures, rather than being removed from the zone between the drill bit and the rock face. The bit grinds the cuttings to smaller fragments, rather than cutting into the formation. This greatly reduces the rate at which the well is drilled and increases wear on the drill bit. The slower rate of penetration and the need to change out the drill bit both extend the time it takes to drill the well.

The improved techniques described below are primarily designed to ensure that the intrinsic rock formation characteristics are not damaged during the drilling process, with the additional benefits of reducing chip hold down, increasing the rate of penetration and reducing wear on the drill bit.

The present invention may be used in a hydrocarbon producing formation, but it is intended for use in a non-producing formation, including but not limited to deep granite and the 'hot dry rock' formations targeted by drillers of geothermal wells. The jet pump drilling method described herein uses a small controlled volume of drilling fluid to lubricate the drill bit and remove the cuttings. Previously, all the fluid pumped down the drill pipe returned up the annulus between the drill pipe and the well bore, or by the opposite path in reverse circulation drilling. Therefore, this jet pump drilling method is a radical departure from conventional drilling because the present invention limits the volume of drilling fluid pumped through nozzles or ports and out through the drill bit.

In the present invention, the drill bit is configured so that some of the drill bit ports originally designed to accept nozzles now become suction ports to allow fluids to flow up through the drill bit. In some embodiments, these suction ports may be specifically engineered to promote the reverse flow up through the drill bit. In other embodiments, the suction ports may be the conventional drilling ports, or even holes in the drill bit intended for the insertion of nozzles, but now serving to permit the internal upward flow through the bit.

It must be kept in mind that the techniques described in this application are used only when drilling a lateral well in a target formation. Conventional methods may be employed when drilling the vertical section of the well, where formation damage is not an issue, including overbalanced drilling and lubrication and cooling of the drill bit by drilling fluid.

In many jet pump applications, cavitation is regarded as a problem because of increased wear. The equipment is designed or chosen to reduce the possibility or the intensity of cavitation. Cavitation can damage parts, and result is a serious loss of efficiency in some cases. The high fluid flow speeds and significant pressure differential in the present application for drilling tends to induce a moderate amount of cavitation.

However, in the present application, cavitation is considered to be a positive feature. It assists with moving cuttings through the drill bit, thus keeping the drill bit free from debris. Therefore, some embodiments of the present invention may modify the design of the drill bit and the jet pump itself to encourage a degree of cavitation.

Referring now to the drawings, several possible embodiments of the present invention will be described. The invention can be implemented in numerous ways. The appended drawings illustrate only typical embodiments of the present invention and therefore are not to be considered limiting of its scope and breadth. In the drawings, some, but not all, possible embodiments are illustrated, and further may not be shown to scale.

In a conventional drilling operation, drill pipe extending from the surface well location to a rotary drill bit is rotated to drill the wellbore. In the present invention, a jet pump is placed between the downhole end of the drill pipe and the drill bit.

FIG. 1 shows the subsurface 100 of the earth within which a drilling rig 102 is drilling a well 104 from a wellhead 106. The first section of the well 104 is drilled as a vertical borehole 108. Using industry standard techniques, the well 104 is deviated through a curved section 110 and then into a horizontal section 112. Drill pipe 114 is shown driving the drill bit 118 through a jet pump reamer/stabilizer 120. As depicted in FIG. 1, the well 104 includes a horizontal section 112, but there would be no changes to the drawing or the description if the well 104 were vertical or angled. It will be understood by one of ordinary skill in the art that FIG. 1 is not drawn to scale. The vertical borehole 108 may extend thousands of feet, as may the horizontal section 112.

As will be apparent from FIG. 1, the initial diameter of the well 104 immediately behind the drill bit 118 is determined by the diameter of the drill bit 118. It will be understood by one of ordinary skill in the art that the dimensions may vary, but industry standards for oil and gas wells suggest that the drill pipe 114 is usually 2⅞" outside diameter, and the drill bit is usually 43/4" in diameter. For geothermal and sequestration wells, the diameter of the well 104 will be significantly larger, especially in the vertical borehole 108.

Figure 2:
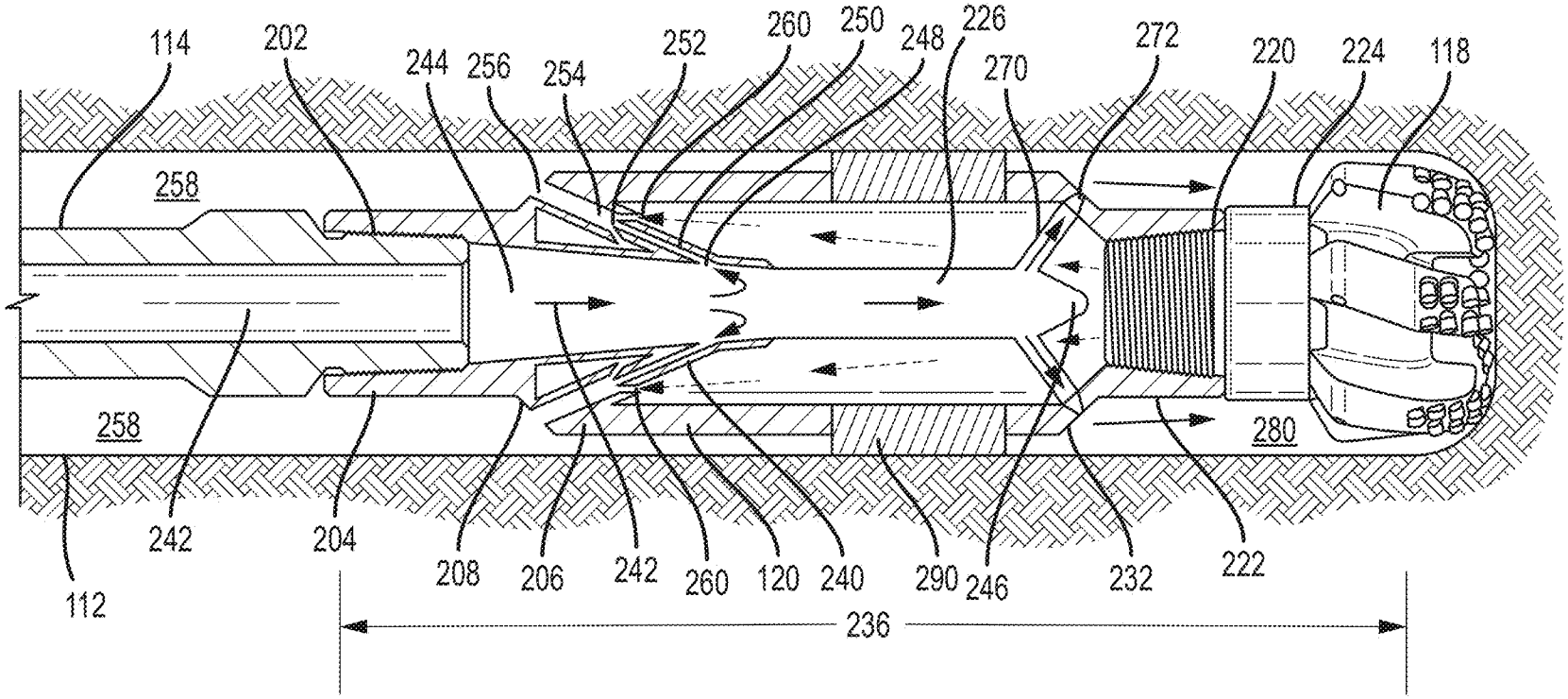
FIG. 2 shows an enlarged cross-section view of the reverse circulation jet pump reamer/stabilizer.

Considering now FIG. 2, in the embodiment shown, the jet pump reamer/stabilizer 120 is attached to the drill pipe 114 by a screw coupling 202. The section 204 of the jet pump reamer/stabilizer 120 which surrounds the screw thread coupling 202 has an outside diameter similar to the outside diameter of the drill pipe 114. The body 206 of the jet pump reamer/stabilizer 120 has an outside diameter slightly smaller than the diameter of the drill bit 118. A first sloping surface 208 connects these two sections 204 and 206 of the jet pump reamer/stabilizer 120.

The drill bit 118 is attached to the jet pump reamer/stabilizer 120 by a screw coupling 220. The section 222 of the jet pump reamer/stabilizer 120 which surrounds the screw thread coupling 220 has an outside diameter similar to the outside diameter of the coupling 224 of the drill bit 118. A second sloping surface 232 connects section 222 of the jet pump reamer/stabilizer 120 to the body 206 of the jet pump reamer/stabilizer 120.

The combination of the jet pump reamer/stabilizer 120 and the drill bit 118 is sometimes referred to as a bottom hole assembly 236.

A venturi assembly 240 is installed within the portion of the jet pump reamer/stabilizer 120 proximate the drill pipe 114. Drilling fluid, now referred to as power fluid 242, is pumped down the drill pipe 114 into the jet pump reamer/stabilizer 120, where it enters the cavity 244 of the venturi assembly 240. The closed end of the venturi assembly 240 acts as a U-tube 246 and reverses the direction of the flow of the power fluid 242. The power fluid 242 exits the cavity 244 through a plurality of discharge ports 248 and along a plurality of discharge tubes 250. Discharge tubes 250 are equipped with venturi nozzles 252, which open into expansion chambers 254. The power fluid 242 exits from the expansion chambers 254 through the exit ports 256 located on the first sloping surface 208, and is then returned to the surface up the annulus 258 between the wellbore 112 and the drill pipe 114.

In accordance with Bernoulli's theorem, as the power fluid 242 passes through the venturi nozzles 252 and into the expansion chambers 254, the fluid pressure drops. The expansion chambers 254 are connected to the body 206 of the jet pump reamer/stabilizer 120 by suction ports 260. The low pressure in the expansion chambers 254 causes the power fluid 242 to be sucked from within the body 206 of the jet pump reamer/stabilizer 120. This causes the power fluid 242 to flow through the drill bit 118 from the rock interface into the jet pump reamer/stabilizer 120. Thus a low pressure zone 280 is created within the jet pump reamer/stabilizer 120 and also around the drill bit 118. The power fluid 242 continues through the discharge ports 248 and along discharge tubes 250 to exit ports 256, and flows to the surface up the annulus 258 between the wellbore 112 and the drill pipe 114.

It will be understood by one of skill in the art that the dimensions of these various components may be varied to tune the performance of the jet pump and optimize the pressure differential and the fluid flow. For example, the venturi assembly 240 may extend further into the internal cavity 244 of the jet pump reamer/stabilizer 120 than shown, as indicated by arrow 226. The internal cavity 244 of the jet pump reamer/stabilizer 120 may be longer than shown if a larger cavity is desired. The length will ultimately be limited by the need to place the entire bottom hole assembly 236 in the lateral well, which means it has to be short enough to pass through the curved section 110 where the well transitions from vertical 108 to horizontal 112. The length, diameter, position and number of the discharge tubes 250 may vary, as may the distance of the discharge ports 248 from the end of the u-tube 246. The dimensions will be determined by a combination of factors, including the type, density and viscosity of the drilling fluid, the pressures of the drilling fluid and formation fluids, the flow rates of the fluids, and the expected size and quantity of cuttings to be removed.

FIG. 2 shows features which distinguish the present invention from the '526 patent to allow some power fluid 242 to flow through to lubricate and cool the drill bit, while maintaining the low pressure area and minimizing formation damage. In the embodiment shown in FIG. 2, the point at which most of the power fluid 242 makes a u-turn to flow through the venturis and back to the surface, that is, the closed end of the venturi assembly 240, is moved closer to the drill bit 118 than in the '526 patent. Most of the power fluid 242 exits the jet pump reamer/stabilizer via the venturi assembly 240 and returns up the annulus 258 between the wellbore 112 and the drill pipe 114.

As shown in FIG. 2, in some embodiments, a series of conduits 270 allow a limited volume of the power fluid 242 to flow out of the jet pump reamer/stabilizer 120. Orifices 272 are used to limit the volume of the power fluid 242 flowing through the conduits 270. The orifices 272 are located on the second sloping surface 232 of the jet pump reamer/stabilizer 120. The actual volume of power fluid 242 flowing through the conduits 270 and orifices 272 is controlled to be only a small fraction of the total power fluid 242 being pumped down the well by varying the dimensions of the conduit and orifice. The power fluid 242 flows around the edge of the drill bit 118 and then flows back up through the center of the drill bit 118. Thus the fluid flow path around the drill bit 118 is what is seen in reverse circulation drilling, while the fluid flow path in the wellbore above the drill bit 118 is in the conventional flow pattern. This retains much of the benefits of the '526 patent, by ensuring that there exists a low pressure zone 280 around the drill bit 118.

The low-pressure zone 280 which exists in the interface between the rock formation and the drill bit 118, is actually a partial vacuum, and thus creates underbalanced conditions ahead of the drill bit 118. One benefit of this low pressure zone is the reduction or elimination of the chip hold down effect. The cuttings are ground to a fine consistency and removed by the power fluid 242 flowing up through the drill bit 118.

Further, as the small quantity of power fluid 242 flows through the constriction of the orifices 272, it increases in velocity and acts as a pressure washer to clean the debris from the walls of the well bore 104 immediately behind the drill bit 118.

In order to maintain the low pressure zone 280 around the drill bit 118, ensure that the power fluid flows 242 through the drill bit 118 and the jet pump reamer/stabilizer 120, and avoid power fluid 242 flowing around the jet pump reamer/stabilizer 120 and reaching the drill bit 118, it is necessary to restrict the annulus between the jet pump reamer/stabilizer 120 and the well bore 104. This is done using a reamer, which is installed around the jet pump reamer/stabilizer 120.

When drilling for oil and gas, it is common to drill the well, then case it, followed by perforating the casing to allow produced fluids to flow into the wellbore. The present invention is intended for applications such as geothermal energy production and CO2 or waste fluid sequestration. In such applications, it is preferable to drill the wellbore open-hole, that is, not cased. This approach maximizes the exposed surface area of the wellbore, and thus the quantity of a working fluid which can be injected into the natural fracture system. FIG. 2 shows a modified reamer 290. The purpose of the reamer 290 in these embodiments is threefold. First, it enlarges the diameter of the wellbore, and removes irregularities which could prevent the bottom hole assembly 236 from being removed, as might be done to change the drill bit 118. Second, it keeps the jet pump reamer/stabilizer 120 centered in the wellbore 112.

Figure 3:
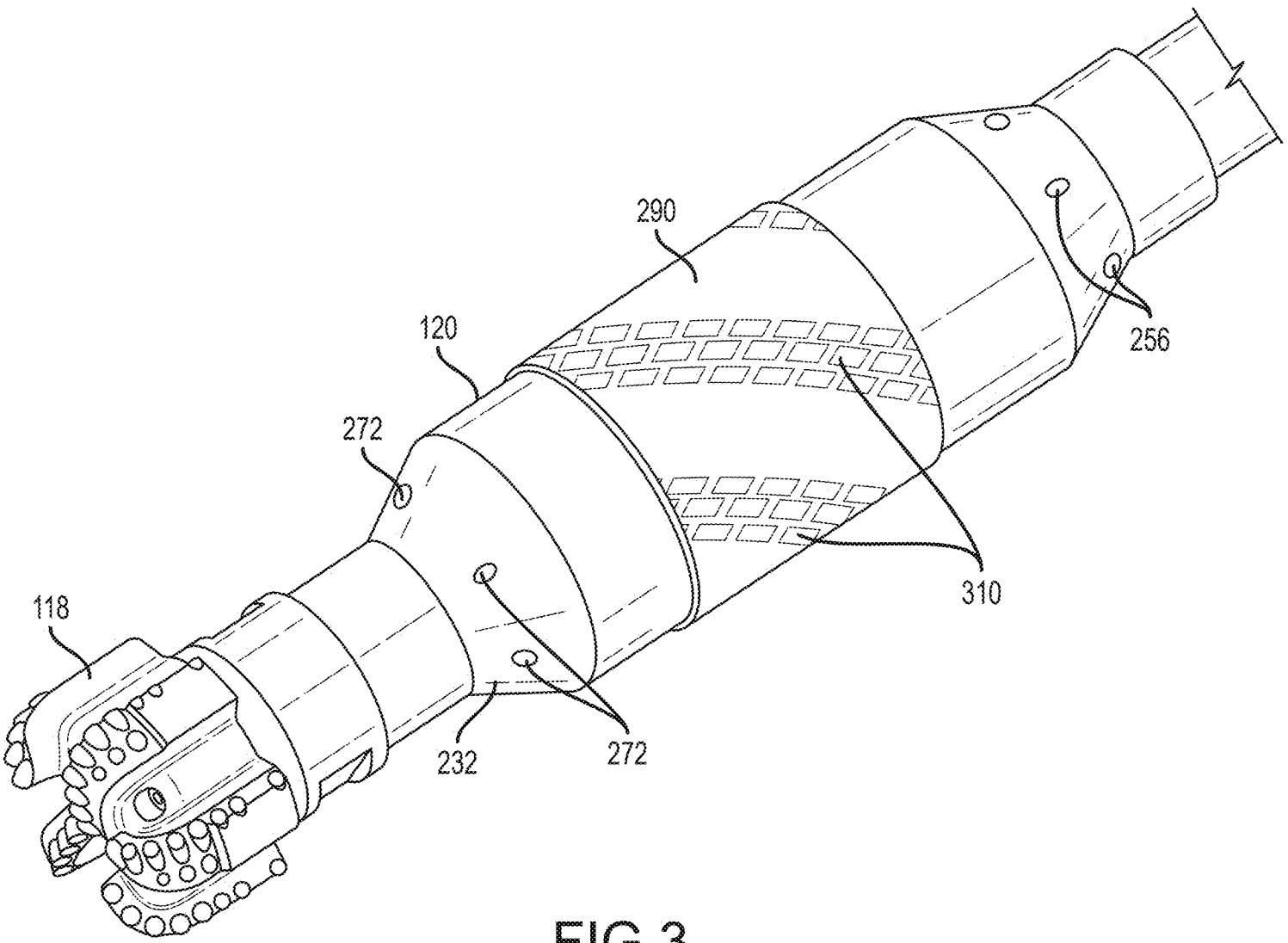
FIG. 3 shows an external view of the reverse circulation jet pump reamer/stabilizer.

Third, it limits the power fluid 242 in the annulus from flowing back into the low pressure zone 280 around the drill bit. Conventional reamers/stabilizers are fluted, that is, they posses grooves which allow power fluid 242 to pass around the reamer, removing cuttings and lubricating the reamer. As shown in FIG. 3, in the present invention, to maintain the low pressure zone 280, the reamer 290 is modified to not have fluting. This use of a non-fluted reamer/stabilizer is not anticipated by the prior art. The cutting diamonds 310 embedded in the reamer 290 project slightly beyond the body of the reamer 290. Therefore the resulting wellbore 112 is very slightly larger then the diameter of the body of the jet pump reamer/stabilizer 120. Much of this small gap is blocked by the cutting diamonds 310. The rock abraded by these cutting diamonds 310 forms a fine powder which is removed by the small quantity of power fluid 242 moving past the reamer 290.

It should be noted that there is a low pressure zone 280 in front of the reamer 290, but there is also a low pressure zone in the annulus 258 behind the reamer 290, as the exit ports 256 are located on the jet pump reamer/stabilizer 120 just behind the reamer.

FIG. 3 also shows, as an external view, the orifices 272 located on the second sloping surface 232 of the jet pump reamer/stabilizer 120.

Figure 4:
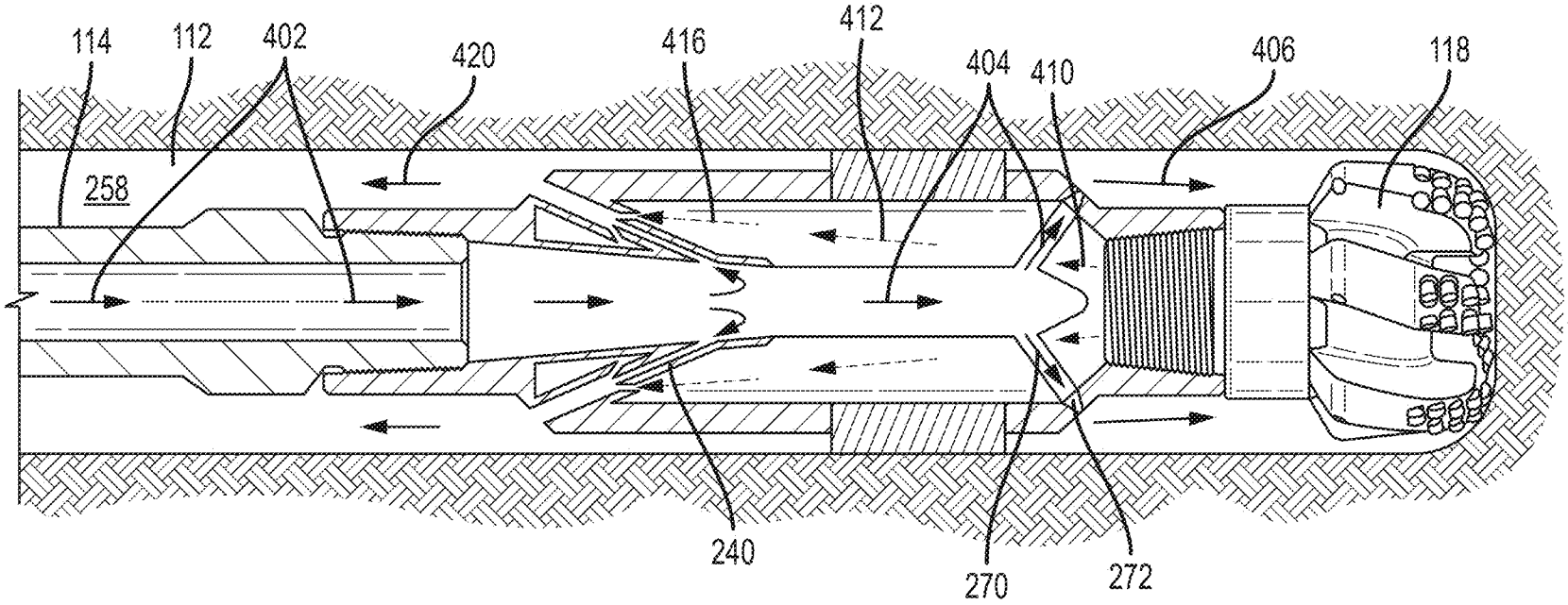
FIG. 4 shows the fluid flow paths through the reverse circulation jet pump reamer/stabilizer.

FIG. 4 shows the direction of the power fluid 242 flow. Arrows 402 show the normal circulation flow of drilling fluid down the center of the drill pipe 114. Arrows 404 show the fluid flow through the internal cavity 226, conduits 270 and orifices 272. Arrows 406 show the low pressure reverse circulation flow around the drill bit 118. Arrows 410 show the reverse circulation flow back up through the drill bit 118. Arrows 412 show the flow back towards the surface inside the body 206 of the jet pump reamer/stabilizer 120. Arrows 416 show the flow through the venturi assembly 240. Arrows 420 show the normal circulation in the annulus 258 between the drill pipe 114 and the well bore 112 back up to the surface. It can therefore be clearly seen that the present invention combines a conventional flow pattern behind the drill bit 118 and a reverse circulation pattern around and in front of the drill bit 118. This hybrid approach allows both underbalanced or near balanced drilling behind the drill bit 118 and a low pressure area in front of the drill bit 118, while lubricating the drill bit 118 and removing the cuttings from the face of the formation being drilled.

In order to appreciate the advantages of the present invention, it is helpful to see how it differs from prior art which discloses jet pumps.

Reference has been made above to the '526 patent which also addresses the issue of formation damage by creating a low pressure zone in front of the drill bit. The present invention differs from the '526 patent in several significant ways. In the '526 patent, no drilling fluid whatsoever flows through the drill bit, whereas in the present invention, a limited volume of drilling fluid does flow up through the drill bit. The '526 patent uses a conventional flow of drilling fluid, down the drill pipe and back up the annulus. The present invention uses a reverse circulation fluid flow around the drill bit, with the drilling fluid being sucked up into the drill bit. The '526 patent discloses a drilling technique tailored to hydrocarbon producing formations where the produced hydrocarbons lubricate the drill bit. The approach disclosed in the '526 patent is not suitable for drilling in hot dry rock formations, basement granite, and other non-hydrocarbon producing formations. The present invention is intended specifically for use in these formations, where no hydrocarbons are produced and therefore lubrication of the drill bit by the drilling fluid is required. It is possible to use the present invention in hydrocarbon bearing formations, with some lubrication being provided as the drill bit passes through zones which produce little or no hydrocarbons.

Consider now U.S. Pat. No. 2,946,565 to Williams entitled "Combination Drilling and Testing Process", hereinafter "the Williams patent"; this patent clearly allows drilling mud to be pumped down through, and out of, the drill bit. In the present application, only a restricted quantity of drilling fluid is allowed through the drill bit. The Williams patent hopes to achieve underbalanced conditions with a jet pump above the drill bit to encourage oil and gas to flow into the wellbore so mud logging testing equipment at the surface can better detect hydrocarbons. It makes clear that above the jet pump the annulus is overbalanced above the jet pump for well control whereas the present invention maintains underbalanced or near balanced conditions throughout the well. The Williams patent does not mention the importance of preventing formation damage, and it essentially acknowledges that testing for hydrocarbons is better done before irreversible formation damage is caused by the overbalanced conditions above the jet pump. It is therefore a testing method, and not a production technique. The present invention is designed for production use, and is intended for use in non-hydrocarbon bearing formations.

Consider also U.S. Pat. No. 5,355,967 to Mueller et al, entitled "Underbalance jet pump drilling method", hereinafter "the Mueller patent". In the Mueller patent, the flow of the drilling fluid through the jet pump is directed down and into the drill bit. In the present invention, the flow through the jet pump is upwards, and only a restricted quantity of drilling fluid flows through the drill bit. In the Mueller patent, there is no reamer separating the suction side and the discharge side of the jet pump, suggesting that it discloses a jetting technique rather than a pumping technique. Without a device such as the reamer disclosed in the present invention, it is difficult to see how the approach described in this patent maintains high pressure above the drill bit and low pressure below the drill bit.

The Mueller patent diverts drilling fluid through the drill bit to lubricate and cool the bit, functions which in the present application are performed by the produced fluids. The Mueller patent refers to using the drilling fluid to entrain the cuttings and remove them. The present invention uses a low pressure zone and a restricted quantity of drilling fluid to remove the cuttings up through the drill bit. The Mueller patent requires a total redesign of the drill bit, foregoing the benefits of many years of development of the roller cone drill bit and greatly increasing costs. The present invention can use conventional off-the-shelf drill bits. For these multiple reasons, the present invention is more practical and cost-effective than the invention described in the Mueller patent.

Consider also U.S. Pat. No. 5,775,443 to Lott entitled "Jet pump drilling apparatus and method", hereinafter "the Lott patent". Once again, this patent is distinguished from the present application because it divides the drilling fluid into two streams and pumps drilling fluid down through the drill bit. The main goal of the Lott patent is to remove cuttings by creating a low pressure area at the bottom of the wellbore. The Lott patent requires a total redesign of the drill bit, foregoing the benefits of many years of development of the roller cone drill bit and greatly increasing costs. The present invention uses conventional off-the-shelf drill bits.

Consider also U.S. Pat. No. 4,630,691 to Hooper entitled "Annulus bypass peripheral nozzle jet pump pressure differential drilling tool and method for well drilling", hereinafter "the Hooper patent". Although this patent does show fluid flowing up through the drill bit, it must be noted that this is drilling fluid which is pumped down the annulus and flows back up through the drill string in a technique known as reverse circulation. This technique is used in specific situations and would not be used in most drilling projects, and certainly not in geothermal or sequestration well drilling The present application does not use reverse circulation. In the Hooper patent, the modulating plug is not intended to provide a complete seal, rather, it is described as a controlled annulus by-pass. Fluid is allowed to flow around the plug, as shown in FIGS. 2-6, in contrast to the present application where no fluid is allowed to flow downward past the reamer and around the jet pump stabilizer and into the face of the drill bit. A further distinguishing feature is that in the Hooper patent, the design intends that the wellbore above the drill bit be overbalanced, which permits formation damage to occur behind the drill bit.

In summary, the common objective for all the prior art is to be underbalanced or at least create a lower pressure around the bit to increase penetration, to reduce lost circulation and in at least one case, to improve hydrocarbon detection, but then be overbalanced above the jet pump for well control.

It should be noted that many of the structures, materials, and acts recited herein can be recited as means for performing a function or step for performing a function. Therefore, it should be understood that such language is entitled to cover all such structures, materials, or acts disclosed within this specification and their equivalents, including any matter incorporated by reference.

It is thought that the apparatuses and methods of embodiments described herein will be understood from this specification. While the above description is a complete description of specific embodiments, the above description should not be taken as limiting the scope of the patent as defined by the claims.

Other aspects, advantages, and modifications will be apparent to those of ordinary skill in the art to which the claims pertain. The elements and use of the above-described embodiments can be rearranged and combined in manners other than specifically described above, with any and all permutations within the scope of the disclosure.

Although the above description includes many specific examples, they should not be construed as limiting the scope of the invention, but rather as merely providing illustrations of some of the many possible embodiments of this invention. The scope of the invention should be determined by the appended claims and their legal equivalents, and not by the examples given.

What is claimed is:

1. A system for drilling an oil, gas, geothermal, or sequestration well or waste disposal reservoir comprising;

a drill pipe;

a drilling fluid pumped down the drill pipe;

a bottom hole assembly attached to the drill pipe, the bottom hole assembly further comprising;

a jet pump housing containing a jet pump, the jet pump having a venturi system through which the drilling fluid pumped down the drill pipe is directed into an annulus between the wellbore and the drill pipe;

conduits in the jet pump housing through which some drilling fluid flows from within the jet pump housing via orifices into the wellbore around the drill bit, through the drill bit and venturi system and back to the surface;

a reamer/stabilizer surrounding the jet pump housing and a rotary drill bit attached to the bottom hole assembly.

2. The system of claim 1 wherein the volume of drilling fluid allowed to flow through the conduits and around the rotary drill bit is controlled by changing the diameter of the orifices.

3. The system of claim 1 wherein the reamer/stabilizer is not fluted.

4. The system of claim 1 wherein the small quantity of drilling fluid flowing through the orifices increases in velocity and acts as a pressure washer to clean drilling debris from the walls of the well bore immediately behind the drill bit.

5. The system of claim 1, wherein the drilling fluid is a light weight fluid.

6. The System of claim 1 wherein the drill bit has nozzles reconfigured as suction ports.

7. The system of claim 1 wherein the drill bit has ports removed to allow the upward flow of drilling fluid.

* * * * *